US012163309B2

(12) United States Patent
Stewart

(10) Patent No.: US 12,163,309 B2
(45) Date of Patent: Dec. 10, 2024

(54) UNDERWATER EXCAVATION APPARATUS

(71) Applicant: Rotech Group Limited, Aberdeen (GB)

(72) Inventor: Donald Stewart, Aberdeen (GB)

(73) Assignee: Rotech Group Limited, Aberdeen (GB)

( * ) Notice: Subject to any disclaimer, the term of this patent is extended or adjusted under 35 U.S.C. 154(b) by 779 days.

(21) Appl. No.: 17/049,305

(22) PCT Filed: Apr. 5, 2019

(86) PCT No.: PCT/GB2019/051002
§ 371 (c)(1),
(2) Date: Oct. 20, 2020

(87) PCT Pub. No.: WO2019/202298
PCT Pub. Date: Oct. 24, 2019

(65) Prior Publication Data

US 2021/0047800 A1 Feb. 18, 2021

(30) Foreign Application Priority Data

Apr. 20, 2018 (GB) ..... 1806451

(51) Int. Cl.
*E02F 3/92* (2006.01)

(52) U.S. Cl.
CPC ..... *E02F 3/9206* (2013.01); *E02F 3/9243* (2013.01)

(58) Field of Classification Search
CPC ..... E02F 3/9206; E02F 3/9243; E02F 5/006; E02F 5/287; E02F 3/9218
See application file for complete search history.

(56) References Cited

U.S. PATENT DOCUMENTS 3,398,694 A * 8/1968 Lerch ..... F04D 29/708 415/232
5,833,444 A * 11/1998 Harris ..... E21B 4/02 418/113
6,053,663 A * 4/2000 Dikken ..... E02F 5/287 37/327

(Continued)

FOREIGN PATENT DOCUMENTS

EA 199900557 A1 2/2000
EP 1092937 A2 4/2001

(Continued)

*Primary Examiner* — Jamie L McGowan
(74) *Attorney, Agent, or Firm* — Dickinson Wright PLLC

(57) ABSTRACT

An excavation apparatus comprises a controlled flow underwater excavation apparatus. A housing thereof comprises at least one inlet and at least one outlet. The at least one inlet is provided on or at a side of the housing. A fluid flow path extends from the/each at least one inlet to the outlet. The fluid flow path comprises a first portion provided at or adjacent the/each at least one inlet. The first portion is included at a non-300 angle, e.g. is substantially perpendicular, to or converges towards a longitudinal axis of the housing and substantially straight. A second portion extends or continues from the first portion. A third portion extends or continues from the second portion. The third portion is substantially straight, contains at least part of a rotor, and is divergent away from the longitudinal axis of the housing in a flow direction from the inlet to the outlet.

25 Claims, 3 Drawing Sheets

(56) References Cited

U.S. PATENT DOCUMENTS

| | | | | |
|---|---|---|---|---|
| 6,430,848 | B1 * | 8/2002 | Susman | E02F 5/287 37/195 |
| 8,893,408 | B2 * | 11/2014 | Susman | E02F 3/8866 37/313 |
| 2010/0139130 | A1 * | 6/2010 | Wagenaar | B63G 8/001 37/342 |
| 2011/0099859 | A1 | 5/2011 | Stewart et al. | |
| 2020/0407940 | A1 * | 12/2020 | Stewart | E02F 3/9243 |
| 2021/0047800 | A1 * | 2/2021 | Stewart | E02F 3/9206 |

FOREIGN PATENT DOCUMENTS

| | | | |
|---|---|---|---|
| EP | 1270826 | A1 | 1/2003 |
| GB | 2297777 | A | 8/1996 |
| GB | 2348448 | A | 4/2000 |
| GB | 2359103 | A | 8/2001 |
| GB | 2538974 | A | 12/2016 |
| SU | 757648 | A1 | 8/1980 |
| SU | 1606620 | A1 | 11/1990 |
| WO | 9827286 | | 6/1998 |
| WO | 2014092567 | A2 | 6/2014 |
| WO | 2014148916 | A1 | 9/2014 |
| WO | 2016133386 | A1 | 8/2016 |
| WO | 2018037232 | A2 | 3/2018 |

* cited by examiner

UNDERWATER EXCAVATION APPARATUS

CROSS-REFERENCE TO RELATED APPLICATIONS

The present application is a 35 U.S.C. § 371 national stage application of PCT Application No. PCT/GB2019/051002, filed on Apr. 5, 2019, which claims priority from GB Patent Application No. 1806451.9 of Apr. 20, 2018, the content of which are incorporated herein by reference in their entireties.

FIELD OF INVENTION

This invention relates to an excavation apparatus, and in particular, though not exclusively, to an underwater (e.g. subsea) excavation apparatus. The invention also relates to an excavation system, device or tool, such as an underwater excavation system, device or tool, and to a method of excavation, such as underwater excavation.

The invention also pertains to an underwater excavation apparatus or system comprising means for disturbing a seabed, ocean floor, lake bed, river bed soil or soils or the like, e.g. for disturbing relatively firm soils.

BACKGROUND TO INVENTION

Mass flow excavators operate by directing a high volume flow of fluid under low pressure at a seabed to displace seabed material. This is in contradistinction to jet type apparatus which direct a low volume flow of fluid under high pressure at the seabed. A mass flow excavator is typically tethered from a vessel by means of a crane wire, which is used to lower and retrieve the excavator, and to maintain the excavator at a given distance from the seabed or structure requiring excavation, such as a subsea oil or gas pipeline. In order to control the excavation, sonar detection means can be used to allow the excavator operator to view the excavation in real time. Cameras and metal detection means can also be used to assist the operator.

Underwater mass flow excavation apparatus are known. For example, GB 2 297 777 A (HOLLANDSCHE BETON-GROEP) and WO 98/27286 (LEDINGHAM CHALMERS TRUSTEE et al), the contents of which are incorporated herein by reference.

Mass flow excavation is a means of creating cavities in a seabed with relatively low pressure(s) (usually measured in Kilopascals, KPa), e.g. in sand, soft clay, and/or pre-loosened or disturbed material. The mass flow excavation may be assisted by a mechanical means or high pressure jetting means for agitating the seabed. These ancillary means of cutting the seabed then rely on mass flow excavation means to remove and disperse the seabed material. Mass flow excavators typically comprise a hollow body or housing and at least one impeller or rotor provided within the housing which draws fluid into the housing and directs the fluid out of the housing towards the seabed.

Known mass flow excavators comprise impellers designed to draw in large volumes of fluid, and to discharge the fluid at relatively low speed and low pressure—typically less than 7 m/s and less than 25 KPa. Due to the relatively low pressure and low fluid flow speed of mass flow excavation, many passes may be required to effectively excavate an area, as with each pass only a limited penetration of the seabed may be achieved. It is a further characteristic of mass flow excavation that trenches created in the seabed may be relatively wide but shallow. This is because the mass flow excavator may first move looser material on the surface due to pressure limitations before penetrating firmer material underneath, creating a wide and ill-defined or uncontrolled excavation profile.

Further, mass flow excavation apparatus are primarily suitable for excavation by directing fluid at the seabed, but due to the low pressure nature of the apparatus, such are of limited use in the collection and removal of seabed material by suction. Thus, after the mass flow device has disturbed the seabed material, a separate tool such as a centrifugal pump, may require to be deployed to suck up and remove the material.

To distinguish from "mass flow", the term "controlled flow" is hereinafter used in connection with an excavator of the present invention which may be configured to produce and/or direct a flow of fluid at a pressure of typically around 35 KPa to 120 KPa and volume flow of typically around 1 $m^3/s$ to 8 $m^3/s$. In contrast to mass flow devices, the higher pressure capability of a controlled flow apparatus or device makes the controlled flow apparatus or device suitable for excavation in both excavation (e.g. jetting) mode and also in suction mode where the device may be used for collection and transportation of seabed material away from an excavation site.

Known controlled flow excavation apparatus suffer from one or more disadvantage(s)/problem(s). For example, if provided with only a vertical facing inlet the excavation apparatus can, in use, cause a vortex at the inlet. This has potential to cause air to be sucked into the excavation apparatus, e.g. if the excavation apparatus is used near the water surface, e.g. in relatively shallow water. The present Inventors have found that adapting or configuring an underwater excavation apparatus, e.g. controlled flow underwater excavation apparatus, to provide horizontal or substantially horizontal fluid flow at an inlet(s) of the excavation apparatus, may enable the excavation apparatus to work or operate more efficiently closer to a surface of a body of liquid/water. The Inventors believe that this may be due to effectively reducing a height of a vortex at the inlet, in use.

It is or may be an object of at least one embodiment of at least one aspect of the present invention to obviate or mitigate one or more problems or disadvantages in the prior art.

It is or may be an object of at least one embodiment of at least one aspect of the present invention to seek to provide an excavation apparatus, such as an underwater excavation apparatus, which is beneficially adapted and/or configured for use in relatively shallow depths, e.g. 1 metre or less.

It is or may be an object of at least one aspect of at least one embodiment of the present invention to provide a means to address a desire for excavating in a relatively controlled and/or rapid manner, e.g. with well-defined seabed excavation profiles.

SUMMARY OF INVENTION

According to a first aspect of the present invention there is provided an excavation apparatus, such as an underwater excavation apparatus or a controlled flow (underwater) excavation apparatus, comprising:

- a housing comprising or having at least one inlet and at least one or an outlet; wherein
- the at least one inlet is provided on or at a side or sides of the housing.

The at least one inlet may be provided around, e.g. circumferentially or peripherally around a/the side of the housing.

The housing may comprise a longitudinal axis. The housing may be symmetrical with respect to the longitudinal axis.

The one or more inlets may be provided inclined and/or offset from or transversely or substantially transversely to the longitudinal axis.

The one or more inlets may be provided perpendicularly or substantially perpendicularly to the longitudinal axis.

The/each of the one or more inlets may be provided non-parallel to the longitudinal axis of the housing.

The/each of the one or more inlets may be provided at an angle, e.g. non zero) (0° angle, e.g. perpendicularly or substantially perpendicularly, to the/each of the one or more outlets.

The/each at least one inlet may be provided near or adjacent an end of the housing.

The/each of the one or more outlets may be provided on or at an/another end of the housing such as on and/or parallel to a/the longitudinal axis.

According to a second aspect of the present invention there is provided an excavation apparatus, such as an underwater excavation apparatus, or a controlled flow (underwater) excavation apparatus, comprising:

a housing comprising at least one inlet and at least one or an outlet; wherein the apparatus is adapted to provide an inclined or horizontal or substantially horizontal or a non-vertical or substantially non-vertical flow of fluid/water into the housing, in use, such as in a first or excavation mode of operation.

The fluid/water flow into the housing may be inclined at a converging or diverging angle to a longitudinal axis of the housing.

The excavation apparatus may be adapted to provide a vertical or substantially vertical or a non-horizontal or substantially non-horizontal flow of fluid/water out of or from the housing, in use.

Any of the features of the second/first aspect of the present invention may be used with or combined with any of the features of the first/second aspect of the present invention.

The following features may be used in the first aspect of the present invention or in the second aspect of the present invention or in any combination of the first and second aspects of the present invention.

The excavation apparatus may be adapted to provide and/or direct, in use, a flow of fluid/water, e.g. at a pressure of 35 KPa to 125 KPa and/or a volume flow of 1 $m^3/s$ to 8 $m^3/s$.

The excavation apparatus may comprise at least one rotor, which may be provided within the housing. The excavation apparatus may comprise at least one stator, which may be provided within the housing.

There may be provided a fluid flow path(s) or passage extending from the/each at least one inlet to the outlet. The at least one rotor and/or the at least one stator may be provided in the flow path.

The/each fluid flow path may comprise a first (inlet) section, which may extend from the at least one inlet.

The/each fluid flow path may comprise a second (rotor) section, which may contain at least part of a rotor. Said second section may diverge away from a/the (longitudinal) axis of the housing.

The/each fluid flow path may comprise a third (stator) section, which may contain at least part of a stator. Said third section may converge towards a/the (longitudinal) axis of the housing.

The/each fluid flow path may comprise a fourth (outlet) section, which may extend to the at least one or the outlet.

The/each fluid flow path may comprise a first inlet portion/first portion which may be provided at or adjacent the/each at least one inlet. Said first inlet portion/first portion may optionally and advantageously converge towards a/the (longitudinal) axis of the housing, e.g. at a non-zero angle, e.g. between 0° and 90°, 45°, and 90°, or at 90°. Said first inlet portion/first portion may optionally and advantageously be substantially horizontal, in use, and/or perpendicular to a/the (longitudinal) axis of the housing and/or said first inlet portion/first portion may be substantially straight.

The/each fluid flow path may comprise a second inlet portion/second portion, which may extend or continue from the first inlet portion/first portion. Said first inlet portion/second portion may optionally and advantageously be curved, bent or arcuate and/or may be convex relative to a/the (longitudinal axis) of the housing.

The/each fluid flow path may comprise a rotor portion/third portion, which may extend or continue from the inlet section/second inlet portion/second portion. Said first rotor portion/third portion may optionally and advantageously be substantially straight, may be coincident with or contain at least a part or parts of the rotor, and/or may diverge away from a/the (longitudinal) axis of the housing, e.g. in a flow direction from the inlet to the outlet, e.g. at an angle $\alpha$ of 45° to 65°, e.g. 55°

The/each fluid flow path may comprise a further or intermediate portion/fourth portion, which may extend or continue from the first rotor portion/third portion. Said second rotor portion/fourth portion may optionally and advantageously be curved, bent or arcuate, and/or may be concave relative to a/the (longitudinal) axis of the housing.

The/each fluid flow path may comprise a stator portion/fifth portion which may extend or continue from the further or intermediate portion/fourth portion. Said first stator portion/fifth portion may optionally and advantageously be substantially straight, may be coincident with or contain at least part or parts of the stator, and/or may converge towards a/the (longitudinal) axis of the housing, e.g. in a flow direction from the inlet to the outlet, e.g. at an angle $\beta$ of 55° to 75°, e.g. 65°. Such arrangement may be of benefit for excavation apparatus adapted for use in relatively shallow waters, e.g. as such may allow for a relatively low profile/height excavation apparatus.

The/each fluid flow path may comprise a first outlet portion/sixth portion, which may extend or continue from the stator portion/fifth portion. Said first outlet portion/sixth portion may optionally and advantageously be curved, bent or arcuate, and/or may be convex relative to a/the (longitudinal) axis of the housing.

The/each fluid flow path may comprise a second outlet portion/seventh portion, which may extend or continue from the first outlet/sixth portion. Said second outlet portion/seventh portion may be provided at or adjacent the outlet. Said second outlet portion/seventh portion may optionally and advantageously be substantially vertical, in use, and/or parallel to a/the (longitudinal) axis of the housing, and/or substantially straight.

The excavation apparatus beneficially may comprise a single rotor.

The excavation apparatus beneficially may comprise a single stator.

In a first mode of operation, which may comprise an excavation mode, the outlet may face an area to be excavated, and in such mode the inlet(s) may be provided above, e.g. directly above, the outlet.

In a second mode of operation, which may comprise a suction mode, the inlet may be proximal an area which has been excavated and/or requires to be cleared, and in such mode the inlet(s) may be provided below, e.g. directly below, the outlet.

The rotor and/or the stator may be provided in the housing. The housing may comprise an axis or longitudinal axis, the rotor and the stator optionally being arranged coaxially upon the axis. The rotor may be provided proximal the inlet(s). The stator may be provided proximal the outlet.

An inside of the housing may converge from the at least one inlet towards the rotor.

The inside of the housing may diverge from the inlet end of the rotor towards the outlet end of the rotor.

The inside of the housing may converge from the stator towards the outlet.

The outlet may be substantially coaxial with the rotor and/or the stator and/or the axis of the housing.

The housing may be circumferentially/rotationally symmetrical about a/the axis of the housing.

The rotor may have a rotor rotation axis, which may comprise or be coincident with a/the longitudinal axis of the housing. The rotor may comprise a first body. The rotor may comprise a plurality of impeller blades which may be provided within the housing, such that, in use, flow of fluid passed or across the rotor may be at a first angle $\alpha$ from the axis of rotation.

There may be excavation and/or suction modes of the excavation apparatus. In excavation and/or in suction mode fluid may flow from the at least one inlet to the outlet of the excavation apparatus.

The rotor rotation axis may extend between (a level of) the at least one inlet and the outlet.

The first body may comprise a first cone member.

The first angle $\alpha$ may diverge away from the axis in a direction away from at least one of the at least one inlets and towards the outlet.

An apex of the rotor or first cone member may face the inlet.

The plurality of impeller blades may comprise aerofoil blades, which may be optionally disposed, such as circumferentially disposed, on a/the first cone member.

The stator may be coaxial with the rotor and/or optionally the stator may be provided between the rotor and the outlet.

In use, flow of fluid passed or across the stator may be at a second angle $\beta$ from the axis of rotation of the rotor.

The stator may comprise a second body, such as a second cone member.

The second angle $\beta$ may converge towards the axis in a direction away from the inlet and towards the outlet.

An apex of the stator or second cone member may face the outlet.

The stator may comprise a plurality of vanes or blades, such as aerofoil blades, which may be disposed on a/the second cone member.

The first angle $\alpha$ may be selected from either: in the range of 45° to 65°, or 55°.

The second angle $\beta$ may be selected from in the range of 55° to 75°, or 65°.

The excavation apparatus may comprise means or an arrangement for dampening reactive torque on the excavation apparatus caused by rotation of a/the rotor, in use.

The excavation apparatus and/or the at least one rotor beneficially may comprise a single rotor.

The torque dampening means beneficially does not comprise a second rotor, such as a second rotor counter-rotating to the at least one (single) rotor.

The excavation apparatus beneficially may comprise at least one stator, such as a single stator.

The housing may comprise a hollow body.

The rotor and/or the stator may be provided in the housing. The housing may comprise an axis. The rotor and the stator may be arranged coaxially, such as upon the axis. The housing may be provided upon the axis. The rotor may be provided proximal the at least one inlet and/or the stator may be provided proximal the outlet.

The rotor may comprise a first body, such as a first cone body, and/or a plurality of (impeller) blades, e.g. disposed on, such as circumferentially around, the first body.

The stator may comprise a second body, such as a second cone body, and/or a plurality of further blades, e.g. disposed on, such as circumferentially around, the second body.

The further or stator blades may comprise one or more, e.g. a plurality of primary stator blades, and/or one or more, e.g. a plurality of secondary or splitter blades which may be provided between adjacent pairs of primary stator blades. Such arrangement may be of benefit in excavation apparatus adapted for use in relatively shallow waters, e.g. as such may allow relatively low profile/height excavation apparatus.

The torque dampening means may comprise or include anti-rotation vanes.

The excavation apparatus may comprise a motor for driving the rotor. The at least one inlet may be provided (longitudinally) between the rotor and the at least one outlet.

According to a third aspect of the present invention there is provided an excavation system, device or tool, such as an underwater system, device or tool, comprising at least one excavation apparatus according to the first aspect of the present invention.

According to a fourth aspect of the present invention there is provided a method of excavation, such as a method of underwater excavation, the method comprising:

providing at least one excavation apparatus according to the first aspect of the present invention; and excavating a location, such as an underwater location, using said excavation apparatus.

It should be understood that any features defined above in accordance with any aspect of the present invention or below in relation to any specific embodiment of the present invention may be utilised, either alone or in combination with any other feature defined in any other aspect or embodiment of the present invention.

BRIEF DESCRIPTION OF DRAWINGS

An embodiment of the present invention will now be described, by way of example only, with reference to the accompanying drawings, which are.

DETAILED DESCRIPTION OF DRAWINGS

Figure 1:
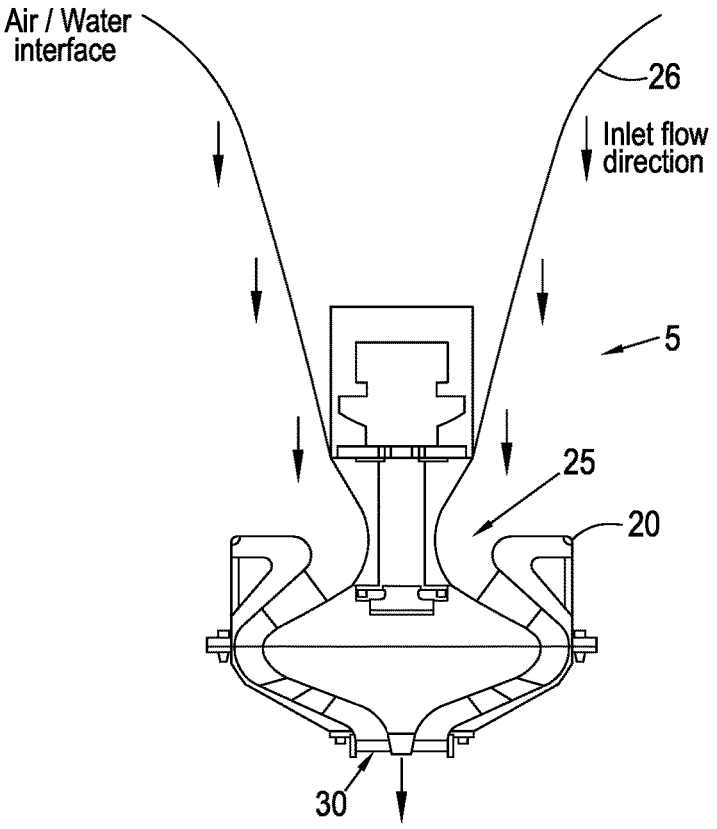
FIG. 1 a schematic sectional side view of an excavation apparatus, in use, said excavation apparatus according to a first embodiment of the present FIG. 2 a perspective view from one side and above of an excavation apparatus according to a second embodiment of the present invention.

Referring initially to FIG. 1, there is shown an excavation apparatus comprising an underwater excavation apparatus, generally designated 5, according to a first embodiment of the present invention.

The excavation apparatus 5 comprises a housing 20 comprising or having an inlet 25 and an outlet 30, wherein the inlet 25 is provided on or at an end (top end) of the housing 20.

As can be seen from FIG. 1, the excavation apparatus 5 has a disadvantage, namely that when operated at or adjacent a fluid/water surface, e.g. in relatively shallow waters, a vortex 26 is produced at the inlet 25, in use. This may lead to the excavation apparatus 5 drawing or sucking air or an air/water mixture into the inlet 25.

Referring now to FIGS. 2 to 5, there is shown an excavation apparatus comprising an underwater excavation apparatus, generally designated 105, according to a second embodiment of the present invention.

The excavation apparatus 105 comprises a "controlled flow excavation apparatus". The excavation apparatus 105 comprises a housing 120. The housing 120 comprises at least one inlet 125 and an outlet 130. The at least one inlet 125 is provided on or at a side or sides 126 of the housing 120.

The at least one inlet 125 is/are provided around, e.g. circumferentially or peripherally around, a/the side 126 of the housing 120, e.g. adjacent an end of the housing. The housing 120 comprises a longitudinal axis A. The housing 120 is symmetrical with respect to the longitudinal axis A. The one or more inlets 125 is/are provided inclined or transversely or substantially transversely to the longitudinal axis A. The one or more inlets 125 is/are provided inclined or perpendicularly or substantially perpendicularly to the longitudinal axis A. The/each of the one or more inlets 125 is/are provided non-parallel to the longitudinal axis A of the housing 120.

The/each of the one or more inlets 125 is/are provided at an angle, e.g. non zero (0°) angle, e.g. perpendicularly or substantially perpendicularly, to the outlet 130. The outlet 130 is provided (centrally) on or at an end 131 of the housing 120.

The excavation apparatus 105 is adapted to provide a horizontal or substantially horizontal or a non-vertical or substantially non-vertical flow of fluid/water into the housing 120, in use.

The excavation apparatus 105 is adapted to provide a vertical or substantially vertical or a non-horizontal or substantially non-horizontal flow of fluid/water out of or from the housing 120, in use, e.g. in an excavation mode.

The excavation apparatus 105 is adapted to provide and/or direct, in use, a flow of fluid/water, e.g. at a pressure of 35 KPa to 125 KPa and/or a volume flow of 1 $m^3/s$ to 8 $m^3/s$.

The underwater excavation apparatus 105 comprises at least one rotor 110, which is provided within the housing 120. The underwater excavation apparatus 105 comprises at least one stator 115, which is provided within the housing 120.

There is provided a fluid flow path(s) F extending from the/each at least one inlet 125 to the outlet 130. The at least one rotor 110 and the at least one stator 115 are provided in the fluid flow path F.

The fluid flow path F comprises a first (inlet) section, which extends from the at least one inlet 125.

The/each fluid flow path F comprises a second (rotor) section, which contains at least part of rotor 110. Said second section diverges away from the longitudinal axis A of the housing 120.

The fluid flow path F comprises a third (stator) section, which contains at least part of stator 115. Said third section converges towards a/the longitudinal axis A of the housing 120.

The fluid flow path F comprises a fourth (outlet) section, which extends to the at least one or the outlet 130.

The/each fluid flow path F comprises a first inlet/first portion $F_1$ which is provided at or adjacent the/each at least one inlet 125. Said first portion $F_1$ converges towards the axis A of the housing 120. Said first inlet portion or first portion $F_1$ is advantageously substantially horizontal, in use, perpendicular to the axis A of the housing 120. In this embodiment the first portion $F_1$ is substantially straight.

The/each fluid flow path F comprises a second inlet portion or second portion $F_2$ which extends or continues from the first portion $F_1$. Said second portion $F_2$ is advantageously curved, bent or arcuate, and convex relative to the longitudinal axis A of the housing 120.

The/each fluid flow path F comprises a rotor portion or third portion $F_3$ which extends or continues from the second portion $F_2$. Said third portion $F_3$ is advantageously substantially straight, coincident with or contains at least a part or parts of the rotor 110, and diverges away from the longitudinal axis A of the housing 120, in this embodiment in a flow direction from the inlet(s) 125 to the outlet 130, e.g. at an angle $\alpha$ of 45° to 65°, e.g. 55°

The/each fluid flow path F comprises a further/intermediate portion or fourth portion $F_4$ which extends or continues from the third portion $F_3$. Said fourth portion $F_4$ is advantageously curved, bent or arcuate, and concave relative to the longitudinal axis A of the housing 120.

The/each fluid flow path F comprises a stator portion or fifth portion $F_5$ which extends or continues from the fourth portion $F_4$. Said fifth portion $F_5$ is advantageously substantially straight, coincident with or contains at least part or parts of the stator 115, and converges towards the longitudinal axis A of the housing 120, in this embodiment in a flow direction from the inlet 125 to the outlet 130, e.g. at an angle $\beta$ of 55° to 75°, e.g. 65°. Such arrangement is of benefit for excavation apparatus 105 adapted for use in relatively shallow waters, e.g. as such may allow for a relatively low profile/height excavation apparatus 105.

The/each fluid flow path F comprises a sixth portion $F_6$ which extends or continues from the fifth portion $F_5$. Said sixth portion $F_6$ is advantageously curved, bent or arcuate, and convex relative to the longitudinal axis A of the housing 120.

The/each fluid flow path F comprises a first outlet portion or seventh portion $F_7$ which extends or continues from the sixth portion $F_6$. Said seventh portion $F_7$ is provided at or adjacent the outlet 130. Said seventh portion $F_7$ is advantageously substantially vertical, in use, parallel to the axis A of the housing 120, and substantially straight.

The excavation apparatus 105 beneficially comprises a second outlet portion or single rotor 110. The excavation apparatus 105 beneficially comprises a single stator 115.

In a first mode of operation, which comprises an excavation mode, the outlet 130 faces an area to be excavated and in such mode the inlet(s) 125 is/are provided above, e.g. directly above, the outlet 130.

In a second mode of operation, which comprises a suction mode, the inlet(s) 125 is/are proximal an area which has been excavated and/or requires to be cleared, and in such mode the inlet(s) 125 is/are provided below the outlet, e.g. directly below the outlet.

The rotor 110 and the stator 115 are provided in the housing 120. The housing 120 comprises axis A, the rotor 110 and the stator 115 being arranged coaxially upon the axis A. The rotor 110 is provided proximal the inlet(s) 125. The stator 115 is provided proximal the outlet 130.

An inside of the housing 120 diverges from the at least one inlet 125 towards the rotor 110. The inside of the housing 120 converges from the stator 115 towards the outlet 130. The housing 120 is circumferentially/rotationally symmetrical about a/the axis A of the housing 120.

The rotor 110 has a rotor rotation axis, which in this embodiment is axis A. The rotor 110 comprises a first body 139. The rotor 110 comprises a plurality of impeller blades 135 which are provided within the housing 120, such that, in use, flow of fluid passed or across the rotor 110 is, in use, at a first angle $\alpha$ from the axis of rotation A.

There are excavation and/or suction modes of the excavation apparatus 105. In excavation and/or suction mode, fluid flows from the at least one inlet 125 to the outlet 130 of the excavation apparatus 105.

The rotor rotation axis A extends between a level of the at least one inlet 125 and the outlet 130. The first body 139 comprises a first cone member. The first angle $\alpha$ diverges away from the axis A in a direction away from at least one of the at least one inlets 125 and towards the outlet 130. An apex of the first cone member faces the inlet 125.

The plurality of impeller blades 135 comprises aerofoil blades, which are circumferentially disposed on a/the first cone member.

The stator 115 is coaxial with the rotor 110 and the stator 115 is provided between the rotor 110 and the outlet 130. In use, flow of fluid passed or across the stator 115 is at a second angle $\beta$ from the axis of rotation of the rotor 110. The stator 115 comprises a second body 140, such as a second cone member. The second angle $\beta$ converges towards the axis A in a direction away from the inlet 125 and towards the outlet 130. An apex of the stator 115 faces the outlet 130. The stator 115 comprises a plurality of vanes or blades 145, such as aerofoil blades, which are disposed on a/the second cone member. The first angle $\alpha$ is typically selected from either: in the range of 45° to 65°, e.g. 55°. The second angle $\beta$ is typically selected from in the range of 55° to 75°, e.g. 65°.

The excavation apparatus 105 comprises means or an arrangement for dampening reactive torque on the excavation apparatus 105 caused by rotation of the rotor 110, in use. The excavation apparatus 105 and/or the at least one rotor 110 beneficially comprises a single rotor. The torque dampening means beneficially does not comprise a second rotor, such as a second rotor counter-rotating to the at least one (single) rotor. The excavation apparatus 105 beneficially comprises at least one stator 115, such as a single stator. The housing 120 comprises a hollow body.

The rotor 110 and the stator 115 are provided in the housing 120. The housing 120 comprises axis A. The rotor 110 and the stator 115 are arranged coaxially, such as upon the axis A. The housing 120 is provided upon the axis A. The rotor 110 is provided proximal the at least one inlet 125, and/or the stator 115 is provided proximal the outlet 130.

The rotor 110 comprises first body 139, such as a first cone body and the plurality of impeller blades 135, e.g. disposed on, such as circumferentially around, the first body 139.

The stator 115 comprises second body 140, such as a second cone body, and a plurality of further blades 145, e.g. disposed on, such as circumferentially around, the second body 140.

Further or stator blades 145 comprise one or more, e.g. a plurality of primary stator blades 146, and one or more, e.g. a plurality of, secondary or splitter blades 147 which are provided between adjacent pairs of primary stator blades 146. Such arrangement can be of benefit in excavation apparatus 105 adapted for use in relatively shallow waters, e.g. as such can allow relatively low profile/height excavation apparatus 105.

The torque dampening means comprise or include anti-rotation vanes 148, e.g. at or proximal the outlet 130.

Figure 2:
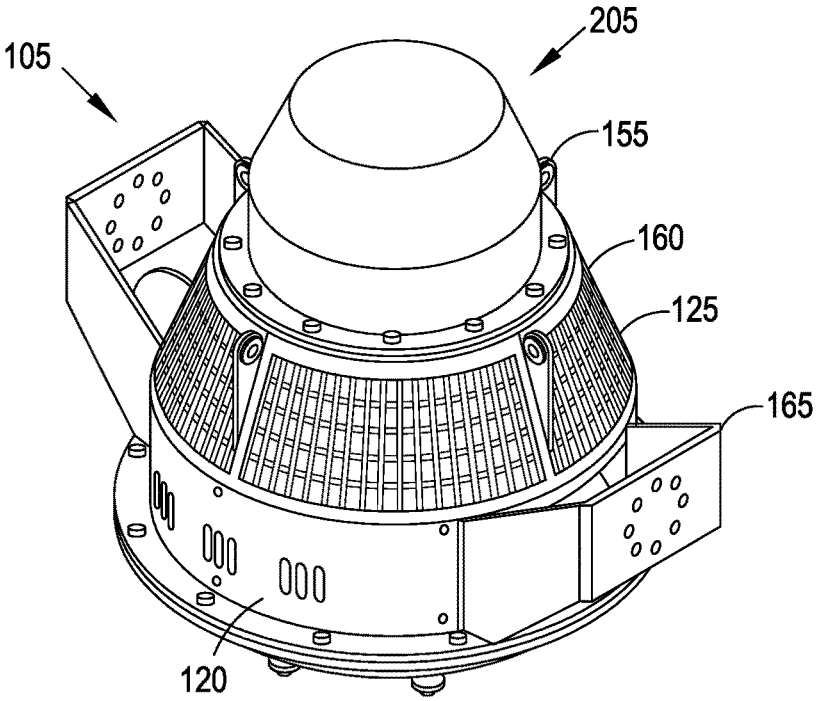

As can be seen from FIG. 2, the excavation apparatus 105 also provides lifting points or lifting eyes 155, e.g. so as to allow suspension of the excavation apparatus 105 from a vessel (not shown) by one or more lines or wires (not shown). Also, at the inlets 125 there is/are provided a safety grill(s) 160, e.g. to mitigate ingress of solids at the inlet(s) 125. The excavation apparatus 105 also provides an attachment arrangement 165, e.g. for mounting of a frame, sonar, camera or the like. The excavation apparatus 105 also provides a drive motor 170 for driving the rotor 110, in use.

The present invention further provides an excavation system device or tool, generally designated 205, such as an underwater excavation apparatus, device or tool comprising at least one excavation apparatus 105.

The present invention further provides a method of excavation, such as a method of underwater excavation, the method comprising:

providing at least one excavation apparatus 105; and excavating a location, such as an underwater location, using said excavation apparatus 105.

Figure 3:
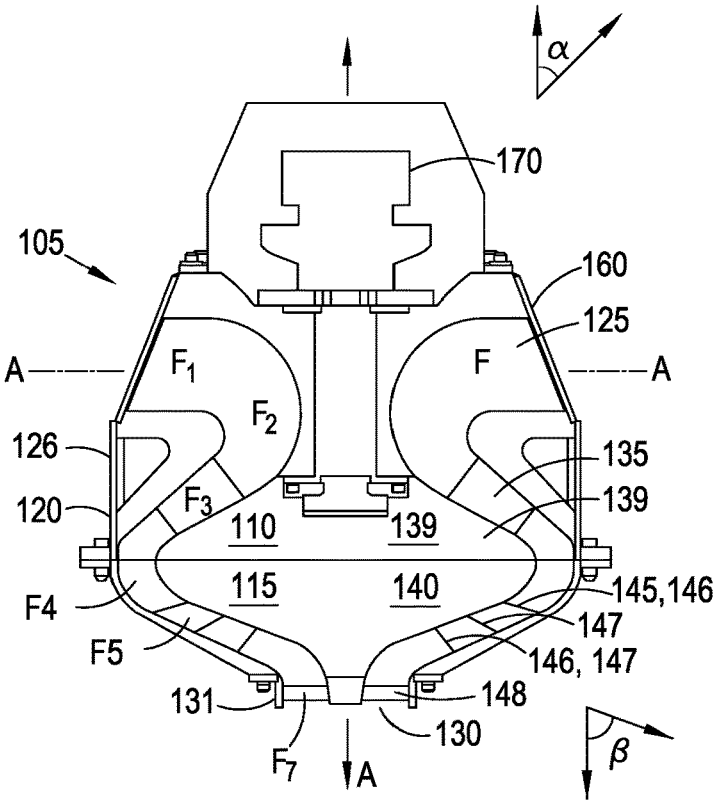
FIG. 3 a schematic sectional side view of the excavation apparatus of FIG. 2.
Figure 4:
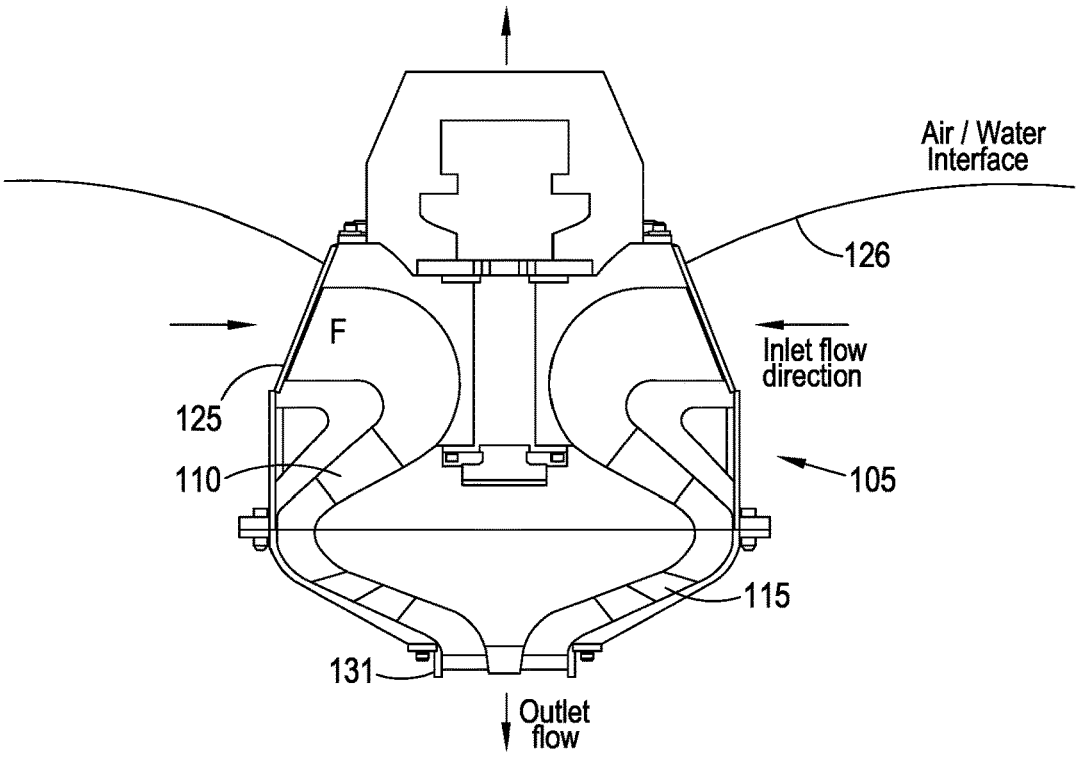
FIG. 4 a schematic sectional side view of the excavation apparatus of FIG. 2, in use.
Figure 5:
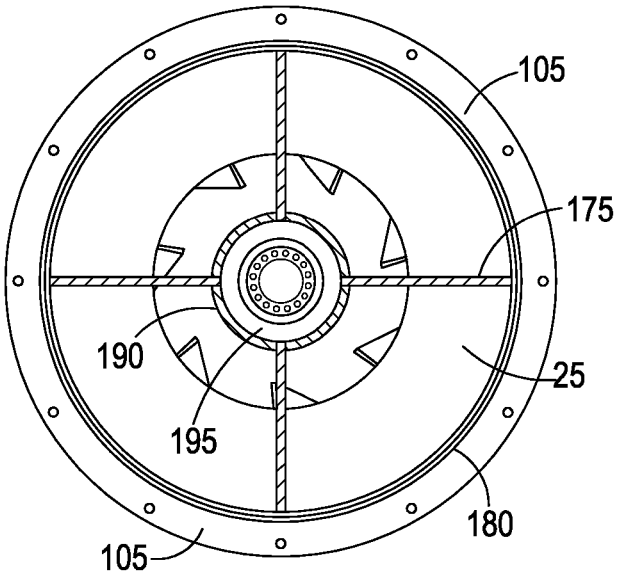
FIG. 5 a schematic sectional view through like A-A of the excavation apparatus of FIG. 3.

Referring to FIG. 5, there is shown in more detail a cross-section of the excavation apparatus 105 taken along line A-A of FIG. 3. As can be seen in this embodiment there is provided four support members 175 which divides the inlet 25 into effectively four inlets. Around the inlet 25 is provided an inlet guard 180 which acts, e.g. to mitigate against ingress of unwanted materials into the inlet 25. Around the inlet 25 is provided a flange 105. On the longitudinal axis A is provided a bearing holder 190 and a bearings and drive shaft 195.

Figure 6:
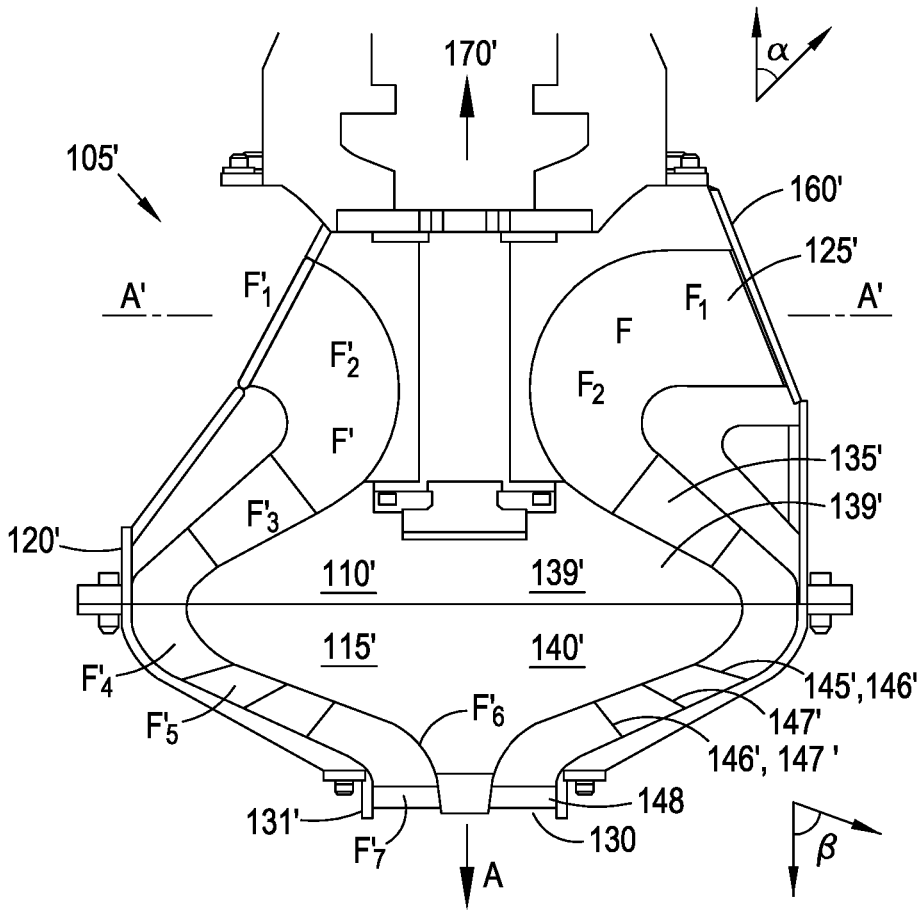
FIG. 6 a schematic sectional side view of an alternative excavation apparatus according to a third embodiment of the present invention.

Referring to FIG. 6, on the left hand side of the drawings there is shown a modified excavation apparatus, generally designated 105', according to a third embodiment of the present invention, parts of the excavation apparatus 105' being denoted with the same numerals as like parts of the excavation 105, but suffixed "'".

The excavation apparatus 105' differs from the excavation apparatus 105 in that the first (inlet) section of the fluid flow path F does not provide a first inlet portion or first portion $F_1$, but rather comprises only second inlet portion or second inlet portion $F_2$.

For comparison purposes, in FIG. 6 the first (inlet) section arrangements of the excavation apparatus 105' and the excavation apparatus 105 are shown on the left hand side and right hand side of the figure, respectively.

It will be appreciated that the embodiment of the present invention hereinbefore described is given by way of example only, and is not meant to be limiting of the invention in any way.

It will be particularly appreciated that the arrangement of the at least one inlet is adapted and/or designed to provide and/or encourage fluid flow ingress from a side or sides rather than an end/top of the housing. This is of particular benefit when operating at or near a surface of a body of fluid/water and/or in relatively shallow depths, e.g. so as to reduce any vortex effects at the inlet. Another key feature of such an excavation apparatus, particularly for such use, is a relatively large stator path converging angle β relative to the longitudinal axis A, as such reduces the required height of the housing. To achieve the shorter, low profile, housing height, the provision of the secondary/splitter blades is of particular benefit.

The invention claimed is:

1. An underwater excavation apparatus comprising:

a housing having at least one inlet and an outlet, wherein the housing defines a fluid flow path from the at least one inlet to the outlet, and wherein the at least one inlet is provided on or at a side or sides of the housing;

at least one rotor within the housing; and at least one stator within the housing; and wherein:

the housing comprises a longitudinal axis, an inside of the housing converges from the at least one inlet towards the at least one rotor such that the fluid flow path converges towards the longitudinal axis, the inside of the housing diverges from an inlet end of the at least one rotor towards an outlet end of the at least one rotor such that the fluid flow path diverges from the longitudinal axis, and the inside of the housing converges from the at least one stator towards the outlet such that the fluid flow path converges towards the longitudinal axis.

2. An underwater excavation apparatus as claimed in claim 1, wherein one of:

the at least one inlet is provided around the side or sides of the housing;

the at least one inlet is provided circumferentially or peripherally around the side or sides of the housing.

3. An underwater excavation apparatus as claimed in claim 1, wherein at least one of:

the at least one inlet is non-parallel to the longitudinal axis of the housing;

the at least one inlet is inclined and/or offset from the longitudinal axis;

the at least one inlet is transverse or substantially transverse to the longitudinal axis;

the at least one inlet is perpendicular or substantially perpendicular to the longitudinal axis;

the at least one inlet is provided at an angle to the outlet;

the at least one inlet is provided at a non-zero (0° angle to the outlet; and/or the at least one inlet is perpendicular or substantially perpendicular to the outlet.

4. An underwater excavation apparatus as claimed in claim 1, wherein at least one of:

the outlet is provided on or at an end of the housing; and/or the outlet is provided on or parallel to the longitudinal axis.

5. An underwater excavation apparatus as claimed in claim 1, wherein at least one of:

the underwater excavation apparatus is adapted to provide a horizontal, substantially horizontal, non-vertical, or substantially non-vertical flow of fluid into the housing, in use; and/or the underwater excavation apparatus is adapted to provide a vertical, substantially vertical, non-horizontal or substantially non-horizontal flow of fluid out of or from the housing, in use.

6. An underwater excavation apparatus as claimed in claim 1, wherein the underwater excavation apparatus comprises a controlled flow underwater excavation apparatus.

7. An underwater excavation apparatus as claimed in claim 1, wherein the underwater excavation apparatus is adapted to provide and/or direct, in use, a flow of fluid/water at a pressure of 35 KPa to 125 KPa and/or a volume flow of 1 $m^3/s$ to 8 $m^3/s$.

8. An underwater excavation apparatus as claimed in claim 1, wherein the underwater excavation apparatus comprises:

a single rotor; and/or a single stator.

9. An underwater excavation apparatus as claimed in claim 1, wherein the fluid flow path comprises at least one of:

a first section which extends from the at least one inlet;

a second section which contains at least part of the at least one rotor, said second section diverging away from the longitudinal axis of the housing;

a third section which contains at least part of the at least one stator, said third section converging towards the longitudinal axis of the housing; and/or a fourth section which extends towards the outlet.

10. An underwater excavation apparatus as claimed in claim 1, wherein the fluid flow path comprises:

a first portion which is provided at or adjacent the at least one inlet, a second portion which extends or continues from the first portion, a third portion which extends or continues from the second portion, a fourth portion which extends or continues from the third portion, a fifth portion which extends or continues from the fourth portion, a sixth portion which extends or continues from the fifth portion, a seventh portion which extends or continues from the sixth portion.

11. An underwater excavation apparatus as claimed in claim 10, wherein at least one of:

the first portion is convergent towards the longitudinal axis of the housing;

the second portion is curved, bent, or arcuate;

the second portion is convex relative to the longitudinal axis of the housing;

the third portion is coincident with or contains at least part of the at least one rotor;

the third portion is substantially straight;

the third portion is divergent away from the longitudinal axis of the housing;

the fourth portion is curved, bent, or arcuate the fourth portion is concave relative to the longitudinal axis of the housing;

the fifth portion is substantially straight;

the fifth portion is coincident with or contains at least part of the at least one stator;

the fifth portion is convergent towards the longitudinal axis of the housing;

the sixth portion is curved, bent, or arcuate;

the sixth portion is convex relative to the longitudinal axis of the housing;

the seventh portion is provided at or adjacent the outlet;

the seventh portion is substantially vertical, in use;

the seventh portion is parallel to the longitudinal axis of the housing; and/or the seventh portion is substantially straight.

12. An underwater excavation apparatus as claimed in claim 1, wherein at least one of:

in an excavation mode, the outlet is configured to face an area to be excavated and the at least one inlet is provided above the outlet; and/or in a suction mode, the at least one inlet is configured to be proximal an area which has been excavated and/or requires to be cleared and the at least one inlet is provided below the outlet.

13. An underwater excavation apparatus as claimed in claim 1, wherein at least one of:

the at least one rotor is provided proximal the at least one inlet;

an apex of the at least one rotor faces the at least one inlet; the at least one stator is coaxial with the at least one rotor;

the at least one stator is provided between the at least one rotor and the outlet.

14. An underwater excavation apparatus as claimed in claim 1, wherein the at least one rotor comprises a plurality of impeller blades.

15. An underwater excavation apparatus as claimed in claim 14, wherein the plurality of impeller blades comprises aerofoil blades.

16. An underwater excavation apparatus as claimed in claim 1, wherein the at least one rotor comprises a first body, wherein the first body comprises a first cone member, and wherein the plurality of impeller blades of the rotor are disposed on the first cone member.

17. An underwater excavation apparatus as claimed in claim 1, wherein the at least one stator comprises a plurality of vanes or blades.

18. An underwater excavation apparatus as claimed in claim 17, wherein the at least one stator comprises a second body, wherein the second body comprises a second cone member, and wherein the plurality of vanes or blades of the stator are disposed on the second cone member.

19. An underwater excavation apparatus as claimed in claim 17, wherein the at least one stator comprises: a plurality of primary stator blades; and a plurality of secondary or splitter blades between adjacent pairs of the primary stator blades.

20. An underwater excavation apparatus as claimed in claim 1, wherein the at least one rotor has a rotor rotation axis.

21. An underwater excavation apparatus as claimed in claim 20, wherein the rotor rotation axis comprises or is coincident with the longitudinal axis of the housing.

22. An underwater excavation apparatus as claimed in claim 20, wherein at least one of:

the at least one rotor comprises a plurality of impeller blades, wherein the plurality of impeller blades are provided within the housing, such that, in use, flow of fluid past or across the at least one rotor is at the first angle $\alpha$ from the rotor rotation axis, the first angle $\alpha$ diverging away from the longitudinal axis in a direction away from the at least one inlet and towards the outlet; and in use, flow of fluid past or across the at least one stator is at the second angle $\beta$ from the rotor rotation axis, the second angle $\beta$ converging towards the longitudinal axis in the direction away from the at least one inlet and towards the outlet.

23. An underwater excavation apparatus as claimed in claim 22, wherein at least one of:

the first angle $\alpha$ is in the range of 45° to 65°;

the first angle $\alpha$ is 55°;

the second angle $\beta$ is in the range of 55° to 75°;

the second angle $\beta$ is 65°.

24. An underwater excavation system, device or tool, comprising at least one underwater excavation apparatus according to claim 1.

25. A method of underwater excavation, the method comprising:

providing at least one underwater excavation apparatus according to claim 1; and excavating an underwater location using said underwater excavation apparatus.

* * * * *